US010276357B2

(12) United States Patent
Zabrouskov et al.

(10) Patent No.: US 10,276,357 B2
(45) Date of Patent: Apr. 30, 2019

(54) METHODS OF ULTRAVIOLET PHOTODISSOCIATION FOR MASS SPECTROMETRY

(71) Applicant: Thermo Finnigan LLC, San Jose, CA (US)

(72) Inventors: Vladimir Zabrouskov, Belmont, CA (US); Chad R. Weisbrod, Tallahassee, FL (US); Christopher Mullen, Menlo Park, CA (US); Seema Sharma, San Jose, CA (US)

(73) Assignee: THERMO FINNIGAN LLC, San Jose, CA (US)

( * ) Notice: Subject to any disclaimer, the term of this patent is extended or adjusted under 35 U.S.C. 154(b) by 0 days.

(21) Appl. No.: 15/849,293

(22) Filed: Dec. 20, 2017

(65) Prior Publication Data

US 2018/0190481 A1 Jul. 5, 2018

Related U.S. Application Data

(60) Provisional application No. 62/440,327, filed on Dec. 29, 2016.

(51) Int. Cl.
*H01J 49/26* (2006.01)
*H01J 49/00* (2006.01)

(52) U.S. Cl.
CPC ..... *H01J 49/0059* (2013.01); *H01J 49/0031* (2013.01)

(58) Field of Classification Search
CPC ..... H01J 49/0059; H01J 49/0031
USPC ..... 250/281, 282, 283, 288
See application file for complete search history.

(56) References Cited

U.S. PATENT DOCUMENTS 9,070,540 B2 6/2015 Brown et al.
9,123,523 B2 9/2015 Green et al.
9,698,001 B2 7/2017 Coon et al.
(Continued)

FOREIGN PATENT DOCUMENTS

CN 106158574 A 11/2016

OTHER PUBLICATIONS

McLuckey et al., "Ion Parking during Ion/Ion Reactions in Electrodynamic Ion Traps", Anal. Chem. 2002, 74, pp. 336-346.
(Continued)

*Primary Examiner* — Nicole M Ippolito
(74) *Attorney, Agent, or Firm* — Nicholas Cairns

(57) ABSTRACT

A method is described that involves simplification of UVPD mass spectra and comprises selecting precursor ions for UVPD fragmentation, performing UVPD fragmentation on selected precursor ions to give UVPD fragment ions. PTR may then be performed on the UVPD fragment ions with optional ion parking to yield charge-state reduced UVPD fragment ions. The UVPD-PTR steps may be repeated above n times where n=1 to 50. Ion parking may enhance the intensity of selected lower fragment ion charge states or to increase the intensity of peaks in selected m/z ranges. After a number of PTR-UVPD iterations, fragment ions are mass analyzed. The method provides a way of simplifying UVPD mass spectral product ions by lowering fragment ion charge states and spreading out resulting product ions in m/z mass spectral space when compared to using UVPD fragmentation alone.

23 Claims, 5 Drawing Sheets

(56) References Cited

U.S. PATENT DOCUMENTS

| | | | | |
|---|---|---|---|---|
| 2007/0057180 | A1* | 3/2007 | Hansen | H01J 49/4225 250/292 |
| 2011/0062323 | A1* | 3/2011 | Brown | H01J 49/0072 250/282 |
| 2011/0114835 | A1* | 5/2011 | Chen | H01J 49/0072 250/282 |
| 2015/0293058 | A1 | 10/2015 | Wuhr et al. | |
| 2016/0020083 | A1 | 1/2016 | McAlister et al. | |
| 2016/0358766 | A1 | 12/2016 | Weisbrod et al. | |
| 2017/0092475 | A1* | 3/2017 | Green | H01J 49/0027 |
| 2017/0162372 | A1* | 6/2017 | Stephenson, Jr. | C12Q 1/04 |
| 2017/0205426 | A1 | 7/2017 | Stephenson, Jr. et al. | |

OTHER PUBLICATIONS

Cannon et al., "Characterization of green fluorescent proteins by 193 nm ultraviolet photodissociation mass spectrometry", Proteomics 2014, 14, pp. 1165-1173.

Holden et al., "Integration of Ultraviolet Photodissociation with Proton Transfer Reactions and Ion Parking for Analysis of Intact Proteins", Anal. Chem. 2016, 88, pp. 1008-1016.

Holden et al., "Ultraviolet Photodissociation of Native Proteins Following Proton Transfer Reactions in the Gas Phase", Anal. Chem. 2016, 88, pp. 12354-12362.

Madsen et al., "Ultrafast Ultraviolet Photodissociation at 193 nm and its Applicability to Proteomic Workflows", Journal of Proteome Research 2010, 9, pp. 4205-4214.

Nie. Shuai, "Chemical Labeling Strategies for Mass Spectrometry-Based Biomolecular Identification, Characterization and Quantification", https://d.lib.msu.edu/etd/3602, Dissertation, Michigan State University (2015), pp. 1-190.

Reilly, "Ultraviolet Photofragmentation of Biomolecularions", Mass Spectrometry Reviews, 2009, 28, pp. 425-447.

* cited by examiner

METHODS OF ULTRAVIOLET PHOTODISSOCIATION FOR MASS SPECTROMETRY

CROSS-REFERENCE TO RELATED APPLICATIONS

This application claims the priority benefit under 35 U.S.C. § 119(e) of U.S. provisional patent application No. 62/440,327 entitled "Methods of Ultraviolet Photodissociation for Mass Spectrometry" filed on Dec. 29, 2016, the disclosure of which is incorporated herein by reference.

FIELD OF THE INVENTION

The present invention relates generally to methods of mass spectrometry and more particularly, it relates to methods of producing simplified fragment ions in mass spectrometry using ultraviolet photodissociation (UVPD) combined with proton transfer reactions (PTR).

BACKGROUND OF THE INVENTION

Analysis of samples by mass spectrometry (MS) often involves the use of one or more stages of ion dissociation, generally referred to as tandem MS, MS/MS or MSn analysis. The dissociation of ions generated from a sample yields characteristic product ions, and the measured intensities and mass-to-charge ratios (m/z's) of these product ions is useful for structural elucidation, as well as for detecting and/or quantifying targeted or untargeted analytes with high specificity. Historically, dissociation has been most commonly performed in mass spectrometers by collisionally activated dissociation (CAD often termed collision induced dissociation or CID) techniques which utilize relatively high-energy collisions between precursor ions and a neutral gas such as helium, nitrogen or argon (commonly referred to as collision gases) to generate product ions consisting primarily of the thermodynamically favored fragments, these are known as b- and y-type ions in protein/peptide mass spectrometry and result from the cleavage of the N—C amide bond in the peptide backbone.

While CAD has been successfully employed for analysis of a wide variety of molecules, including biomolecules such as peptides, more recently developed dissociation techniques such as electron transfer dissociation (ETD) have been found to be particularly useful for analysis of intact proteins, especially those with post-translational modifications, among other relatively large molecules and especially larger biomolecules. Another such technique is ultraviolet photodissociation (UVPD), in which analyte precursor ions are irradiated with ultraviolet (UV) radiation produced by a UV source, typically a laser. For protein or polypeptide analytes, absorption of UV radiation causes fragmentation to proceed through all known peptide backbone fragmentation pathways, producing primarily a- and x-type fragment ions, but also b-, c-, y-, and z-type fragment ions as well as side-chain fragment ions. The principles and usage of UVPD are described by Brodbelt et al. (Journal of the American Chemical Society, (2013), 135(34), pp. 12646-12651) and by Reilly et al. (U.S. Pat. No. 7,618,806B2). Generally the terms protein and peptide both indicate polymers of varying lengths of amino acid polymers with proteins generally having a greater number of amino acids than the peptides. The term polypeptide as used herein may mean protein or peptide and is generally used to indicate an amino acid polymer that may be seen as a large peptide or a small protein. Herein the terms protein, polypeptide and peptide may be used interchangeably to describe any length of amino acid polymers.

The term ion trap as used herein means a RF electric field ion containment device where ions may be contained in three dimensions (not just in two dimensions as in the case of an ion guide) and may be a linear two dimensional (2D) ion trap or 3D Paul trap. A linear ion trap may be segmented into a plurality of sections, each section having a separate set of electrodes, for example, a linear ion trap with three discreet ion containment sections may have a front section, a middle section and a rear section. In such a device ions may be contained in the trap in various ways, for example, positive ions may be contained in one or more sections and at the same time, negative ions may be contained in different section(s) of the trap. This feature of a segmented linear ion trap greatly facilitates ion-ion reactions such as proton transfer reactions (PTR). A linear ion trap may comprise two distinct linear ion traps such as a high pressure ion trap and a low pressure ion trap (as used in the Thermo Velos or Fusion lines of mass spectrometers, Thermo Fisher Scientific, San Jose, Calif.).

Ultraviolet photodissociation (UVPD) is a technique that utilizes ultraviolet (UV) light rays from UV emitting lasers with the basic process resulting in fragmentation of precursor ions and the subsequent generation of product ions. Polypeptide sequence determination is central to study of biomolecules and for advancing the field of proteomics and clinical diagnostics. Interrogation of polypeptide sequences is most efficiently probed via mass spectrometry. Modern mass spectrometers come equipped with a large array of fragmentation techniques to enable the study of a broad range of molecular compounds. Fragmentation of intact polypeptide species with the appropriate techniques allows for predictable peptide backbone fragmentation. UVPD provides broad and deep fragmentation of proteins, thus giving high sequence coverage, and is well-suited for high throughput proteomics. It is a promising technique for polypeptide fragmentation that is relatively indiscriminate in its fragmentation products. In this technique, gas phase intact protein ions are irradiated with a UV light source (typically a laser). When using a laser of relatively high photon density and energy, photodissociation may proceed via single photon mechanisms or may proceed by 2 or 3 or more photon mechanisms. With such techniques, fragmentation may proceed through all known peptide backbone fragmentation pathways simultaneously producing a, b, c, x, y, and z fragment ions, and may also include side chain fragmentation.

UVPD fragmentation spectra of intact proteins are complex with many overlapping multiply charged fragment ions distributed over a relatively narrow mass to charge (m/z) range making confident peak assignment difficult, hence, there is a need to simplify such spectra. The most common reaction in MS/MS is that of dissociation following ion activation. In the simplest case, singly charged parent ions fragment to yield singly charged and neutral products. Reactions involving a change in charge, often referred to collectively as charge permutation reactions have been known since the beginning of mass spectrometry. One particular advantage of UVPD is that not only does it inherently provide a broad range of protein/peptide fragmentation coverage but it is suitable in many cases for the identification of post-translational modifications (PTMs) since weakly bonded PTMs such as phosphates or glycans often survive this fragmentation process. The detection of PTMs is of increasing importance in proteomics.

As outlined above, broad fragmentation coverage is a clear advantage of UVPD fragmentation. However, this broad coverage often results in a relatively large number of overlapping higher charge states product ion peak envelopes that become increasingly difficult to deconvolute with increasing molecular weight of the fragment ions. Accordingly, advances in the simplification of UVPD mass spectra are desirable.

SUMMARY OF THE INVENTION

A method of producing product ions for mass analysis is described. The method may simplify interpreting UVPD mass spectra and comprises optionally mass selecting precursor ions for UVPD fragmentation, for example, by using a quadrupole mass filter or ion trap, performing UVPD fragmentation on (selected) precursor ions to give UVPD fragment ions. UVPD fragmentation may be performed by using a single laser pulse or by using multiple laser pulses. A single laser pulse of relatively high energy (in the milli-Joule pulse range) may be used that results in a high degree of fragmentation or a single laser pulse may be used that results in significantly lower fragmentation. When using multiple laser pulses, each pulse of a laser may be of relatively low energy, where each pulse may result in significantly lower fragmentation (micro-Joule pulse range). Following each UVPD event (where either a single pulse is used or where multiple pulses are used) PTR may be performed (also known as ion-ion proton transfer, IIPT) on the UVPD fragment ions to yield charge-state reduced UVPD fragment ions and the UVPD-PTR steps above may be repeated n times where n=1 to 50. After a number of PTR-UVPD iterations, fragment ions are mass analyzed. The method provides a way of simplifying UVPD mass spectral product ions by lowering fragment ion charge states and spreading out resulting product ions in m/z mass spectral space when compared to using UVPD fragmentation alone. A mixture of product ion isotopic envelope peaks with a lower number of charge states that are well separated in m/z space are easier to deconvolute than UVPD fragments that have not been subjected to PTR and that have a greater number of charge states crowded into a narrower range of m/z space.

The method may be performed by using a quadrupole mass filter or by using a quadrupole or an ion trap for mass selection. Ion parking of precursor or product ions may be performed during any iteration of PTR steps so that selected precursor or product ion populations are removed from the region in which PTR occurs, thereby preventing the undesirable depletion of desired precursors or product ions.

BRIEF DESCRIPTIONS OF THE DRAWINGS

DETAILED DESCRIPTION

Figure 1:
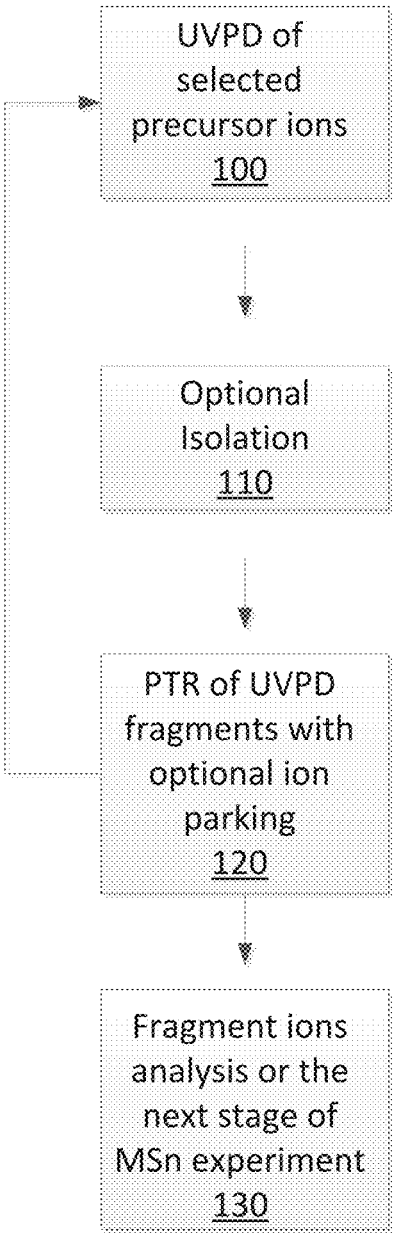
FIG. 1 shows a flow chart depicting a workflow of an embodiment of the present invention.

Large molecules and especially large biomolecules and larger dissociative fragments of these molecules often display a large number of charge states in both positive and negative ion MS, especially in electrospray ionization mass spectrometry (ESI-MS). This is often problematic as a large number of charge states may appear very close and often overlap in the relatively small m/z range in which the product ions appear. A method of mass spectrometry is described herein where precursor ions are selected and dissociated by irradiation with one or more pulses of UV light into product ions, and the resulting positively charged product ions are subjected to PTR using reagents such as, $SF_6$—, anionic perfluorodecalin or other perfluorohydrocarbons, which results in shifting more product ion charge states at a lower charge state number and thus "simplifies" mass spectral analysis by lowering the number of mass spectral peaks that appear in the same m/z analysis window or by lowering the spectral peak density (number of peaks per m/z). Prior to mass analysis, further cycles of UV irradiation of precursor ions followed by PTR in various combinations may be performed in order to optimize the simplification process.

In bottom-up or top-down proteomics UVPD experiments may be performed in order to maximize the information available by maximizing the abundance of dissociated product ions within mass spectral m/zs. The degree of UVPD fragmentation depends upon the conformation of the cations (or anions), the amount of ions irradiated, the laser wavelength and power together with other instrumental factors. Furthermore, it can be difficult to know a priori the optimal parameters for every anion-cation combination from an LC run.

Fragment ions resulting from the UVPD process contain a high level of multiply charged species having an increasing number of charge states with increasing fragment ion mass. These ions partition into many fragment channels over many charge states, leading to overlapping isotopic clusters. This is problematic since highly charged fragment or product ions can be hard for a mass spectrometer to resolve. The precursor ions which are fragmented by UVPD may, for example, have a charge state of 5+, 6+, 7+, 8+, 9+, 10+ or much higher and the resulting fragment or product ions may, for example, have a charge state of 4+, 5+, 6+, 7+, 8+, 9+ or much higher. During a UVPD event there is very little, if any reduction of the net charge and a lot of fragments tend to stay in a relatively narrow m/z bin around the original precursor, increasing the spectral peak density and complicating deconvolution.

As used herein, the term "product ion" refers to any ion that is a fragment ion (also known as secondary ion or daughter ion), of a precursor ion. The term "precursor ion" may refer to an ionized intact molecule such as an ionized intact protein or ionized oligonucleotide or similar that carries an overall positive or negative charge. It may refer to an adduct ion where in positive ion mode, an intact molecule has combined with one or more of, a proton, an ammonium ion or a metal ion to produce an ion that is overall positively charged. In negative ion mass spectrometry, an intact protein or oligonucleotide or similar carries a negative charge overall. The term "precursor ion" as used herein may also refer to a product ion that is selected for a further round(s) of fragmentation.

According to an embodiment of the present invention a method of producing product ions is described comprising selecting precursor ions for UVPD fragmentation. Selection of positively or negatively charged precursor ions may be achieved by using a quadrupole mass filter or by using a quadrupole ion trap device such as a 3D quadrupole ion trap or by using a 2D linear quadrupole ion trap (LIT). Removal of unwanted ions from ion traps may, for example, be achieved by resonance ejection, wherein any unwanted ions leave the trap by either an axial ejection mode or by a radial ejection mode. Precursor ions may be biopolymers such as intact proteins or oligonucleotides or they may be relatively polar synthetic polymers such as polyesters, polyimines or polyethylene glycols, combinations of any of these polymers, or molecules where such polymers have been added to other molecules, for example, to increase the bioavailability of small molecule pharmaceuticals. The term "precursor ions" as used herein may also apply to smaller units of biopolymers such as peptides derived from enzymatic digests of proteins and importantly, these truncated molecules or molecular ions may have be previously fragmented ions that are selected for at least one further round of fragmentation followed by mass analysis.

Embodiments of the present invention are particularly directed to the top down analysis of proteins, that is, where mass spectral analytes are intact proteins rather than a plurality of smaller peptides resulting from bottom up protein enzyme digestion. A protein analyte may be fragmented by UVPD within a mass spectrometer resulting in a series of product ions. Each product ion may appear as a series of peaks representing different charge states of the fragment. Each charge state group in each series has a fine set of isotopic envelope peaks, the appearance of each individual charge state isotopic envelope will depend on the value of its charge state, its molecular weight, its relative abundance and on the resolution of the mass spectrometer. For example, a charge state envelope with a high molecular weight, high charge state being analyzed on a relatively low resolution mass spectrometer may appear as a single broad peak. Such a peak representing an average weight of the isotopic envelope peaks. Incomplete fragmentation would also lead to the appearance of a group of precursor ion charge state peaks for an intact protein which may further complicate fragment ion deconvolution. In an ESI mass spectrum, the precursor ion of a protein with a molecular weight of 20,000 Daltons may appear as a series of charge states between m/z 1000 to 2000. For example, the 10+ charge state may appear as an isotopic envelope of peaks around 2001 m/z—this would represent the protein itself (20,000) plus 10 protons that contribute 10 positive charges (20,000+10=20010) divided by 10 (the charge state as the MS only sees m/z)=2001. The 20+ charge state would appear as an isotopic envelope of peaks around 1001 m/z—this would represent the protein itself (20,000) plus 20 protons that contribute 20 positive charges (total mass 20,000+20=20020) divided by 10 (the charge state, z, as the MS only sees m/z)=1001. The 11+, 12+, 13+, 14+, 15+, 16+, 17+, 18+, and 19+ charge state isotopic envelopes would appear at their appropriate m/z range in between 1001 and 2002 m/z. Each isotopic envelope representing an individual charge state would comprise a series of isotopic peaks due mainly to the presence of isotopes of H, C, N, O and S.

UVPD fragmentation of such a protein may afford, for example, a fragment at 1000 m/z together with a complementary fragment at 19,000 m/z. Also, a 20 k protein with 20+ fragments near the middle, may afford 2×10 k 10+ species, having the same m/z as the precursor. This is why there is clustering in the UVPD spectra near the precursor m/z. Each of these fragments may show similar types of charge state distributions as the precursor protein shows above and as there are thousands of potential UVPD product ion fragments, it is clear that severe overcrowding may occur in m/z space which increases with an increasing number of charge states. Therefore, if the number of fragment ion charge states could be lowered by PTR, UVPD mass spectra would be less over-crowded and hence simplified for mass spectral analysis.

In the PTR process, it is known that when multiply charged precursor analyte ions are mixed with reagent ions of opposite polarity, protons may be transferred from the cation to the anion, thus reducing the charge state of the cation. In positive ion mode, the cation may be an analyte such as a protein or peptide and the anion may be an electron rich PTR reagent.

A variety of ion-ion proton transfer (IIPT) reactions have been described, for example, see McLuckey et al.; Anal Chem., 2002, 74(2) 336-346; Hunt et al., Mol. Cell Proteomics, 2016, 15(3), 975-988; Brodbelt et al., Anal. Chem., 2015, 88, 1008-1016). In an embodiment of the present invention, UVPD fragmentation of an intact protein may be performed by using one pulse of an excitation laser followed by variable amounts of time to allow for PTR.

PTR reagent ions such as the $SF_6$— anionic reagent may be produced in a separate electron impact (EI) ion source (negative ion mode) or in a glow discharge ion source (this source is separate from the main ESI analyte ion source) and may be, for example, a front-end ion source designed for electron transfer dissociation (FETD). PTR anions may be introduced into the trap in various ways, for example, precursor ions may be segregated into one segment of a linear ion trap, and PTR ions may then be introduced into a separate segment of the trap. The positively charged precursor ions may then be mixed with the PTR anions for a user-defined amount of time (for example, 20 to 200 ms). During this step fragment ion charge states will be reduced by losing one or more protons to the anionic PTR reagents. Parallel ion parking may optionally be performed during this step. PTR ion-ion reactions may be quenched by several known methods including removal of remaining PTR anions from the trap or removal of product ions from the trap.

Parallel ion parking may be performed during a PTR using harmonic excitation of selected ions within the ion trap to reduce their reactivity in gas-phase ion/ion reactions. This allows PTR to be performed without reacting the precursor outside of the targeted product m/z range. The above process may then be repeated or looped until an appropriate amount of spectral simplification has been achieved.

In an alternative embodiment, a loop involving a plurality of laser pulses directed towards precursor ions followed by an appropriate amount of PTR time may be performed before mass analysis. Laser power may be varied accordingly so that for example, in the case above where multiple laser pulses are performed before PTR, a laser with lower power is used. Alternatively, a laser of higher power may be used in a case where only one laser pulse is used prior to PTR. In another case, the same laser power may be used for both cases. Yet another embodiment may involve combinations of the above two loops prior to mass analysis. It should be noted that very fine control of UVPD activation may be achieved with this approach relative to a high powered laser operating a lower pulse energy.

In an alternative embodiment of the present invention, product ion parking may be performed at desirable (lower)

charge states or at desirable higher m/z mass ranges to prevent ions from forming lower charge states that are outside the range of detection of the mass spectrometer and would therefore be lost for analyses purposes. For example, the 4+ charge state of a protein fragment with a molecular weight of around 10,000 amu would be around 2500 m/z which would be out of the "up to" 2000 m/z mass range of many commercial ESI mass spectrometers. In this case, product ion parking could be directed to, for example, the 7+ charge state of the 10,000 amu product ion which would result in ions amassing in for example, an ion trap conveniently at around 1430 m/z.

FIG. 1 shows a flow chart depicting an embodiment of the present invention where selected precursor ions are subjected to UVPD fragmentation 100. As described above the UVPD fragmentation may consist of a single pulse at a specific power or energy level, or may consist of a plurality of laser pulses at specific power or energy levels from a variety of appropriate UV lasers. Prior to any round of spectral simplification by PTR 120, in 110 optional isolation or optional MS3 or MSn isolation may be performed as UVPD activation may fragment initial fragments to give MSn product ions. PTR spectral simplification 120 may be effected by allowing UVPD fragment ions to react with a pre-determined population of PTR reagent ions such as $SF_6$— ions (for positively charged fragment ions) which may be performed for a pre-determined amount of time. Optional ion parking may be performed during any round of PTR. This may result in a decreased number of higher charge states for the population of fragment ions, that is, the fragment ion population may be distributed over a greater number of lower charge states than before PTR and hence will be spaced out further in m/z space. As a result of greater spacing between fragment ion populations, significant overlap between these populations in m/z space becomes less of a problem and significantly more efficient spectral deconvolution would be expected (the less overlap between fragment ion populations is in m/z space, the greater the chance of cleaner deconvolution) leading to a greater confidence in UVPD m/z assignments. This may be followed by mass analysis or the next stage of MSn experiment 130.

Figure 2:
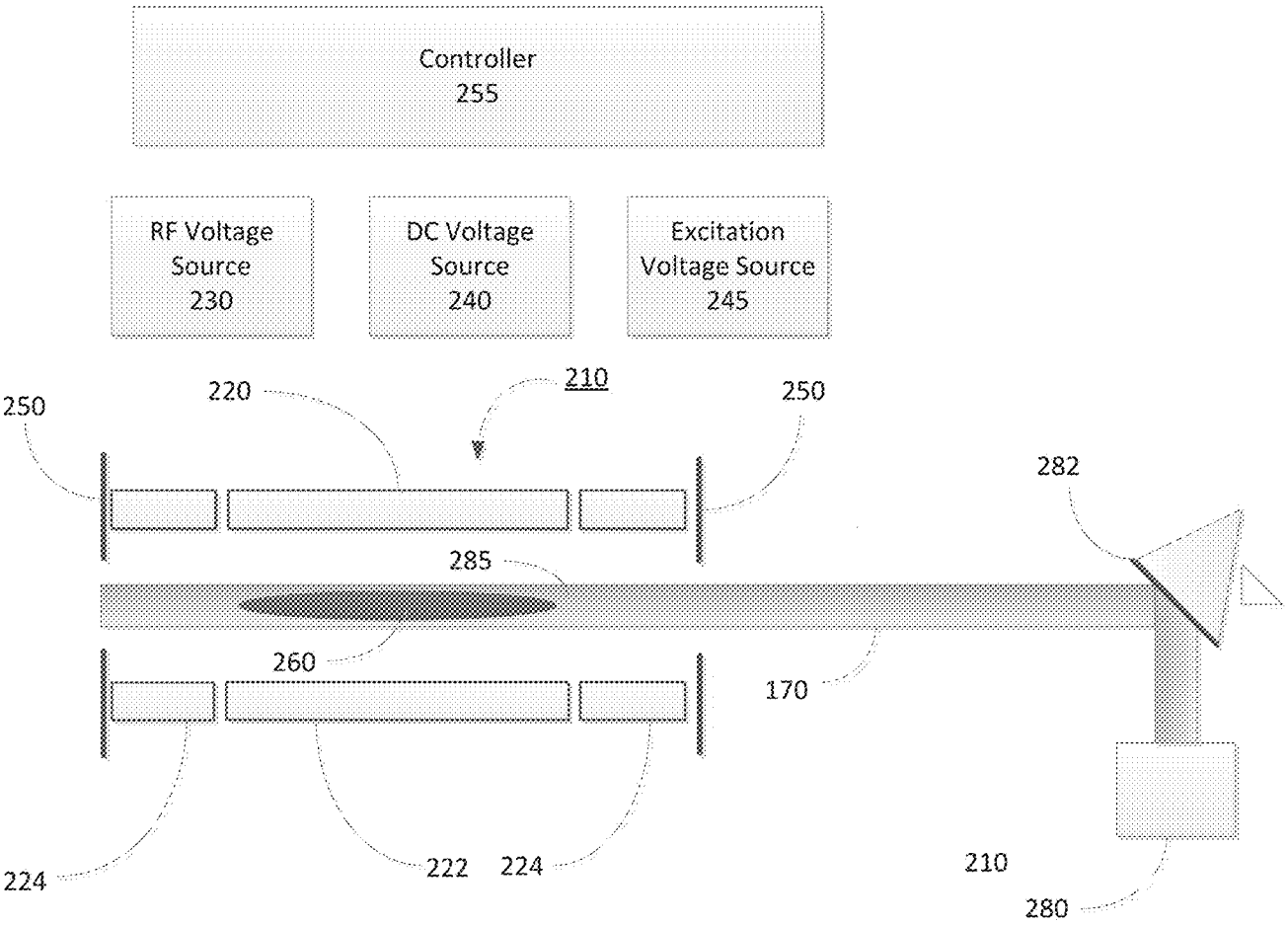
FIG. 2 shows an apparatus for performing UVPD in a linear ion trap or RF ion containment device, comprising a controller, voltage sources, a segmented linear ion trap and a laser source.

FIG. 2 shows a cross sectional view of a segmented linear ion trap. A laser 280 emits an irradiating UV laser beam 170 to excite a precursor ion population 260 in a segmented linear ion trap 210. Briefly, the trap has two end lenses 250 that allow ions to enter and can constrain the ions in the trap, a controller 255, voltage sources 230, 240, 245 and twelve electrodes (six shown) 224 and 222. Ions may enter and leave the trap via holes in the end lenses 250 or may be resonantly radially ejected from the trap through holes in electrodes 220. Radial confinement of ions is achieved by the application of a radio-frequency (RF) voltage to electrodes 220 by RF voltage source 230. In a typical mode of operation, the two electrode pairs receive a RF voltage of substantially equal amplitude in an opposite phase relationship. Confinement of ions in the longitudinal dimension (i.e., along the ion trap's central axis) may be effected by applying different DC voltages from DC voltage source 240 to the end 224 and central 222 segments of the electrodes to define a potential well that is roughly co-extensive with the length of the central segment. For example, if the confined ions are cations, the potential well may be established by applying DC voltages to the end segments that are higher relative to the DC voltage applied to the central segments. In other implementations, the DC potential well may be established by applying suitable DC voltages to end lenses 250 positioned axially outwardly of electrodes 220. The operation of RF voltage source 230 and DC voltage source 240, as well as excitation voltage source 245 and UV source 285 and other components of the associated mass spectrometer, is directed by controller 255, the function of which may be distributed across several discrete components, such as general-purpose and specialized processors, application-specific circuitry, memory and storage, and which may be configured to execute software code to implement one or more of the steps described below.

The combination of RF and DC fields described above confines unexcited ions to a thin, generally cylindrical volume located near the ion trap central axis and extending along the DC potential well (e.g., substantially coextensively with the central segments), referred to herein as ion cloud 260. As is known in the art, the dimensions of ion cloud 260, and specifically its radius, will vary according to the amplitude and frequency of the applied RF voltage, the m/z's and masses of the trapped ions, as well as the pressure of background gas within ion trap 210.

To dissociate ions in ion trap 210 by UVPD, a beam 270 of UV radiation of suitable properties is passed into ion trap 210, preferably along a path that is coaxial to or parallel to the ion trap central axis. UV beam 270 is emitted by a source 280 and the beam path may be directed along the ion trap by one or more reflectors or other ion optics, such as mirror 282. Source 280 may take the form of a laser or other device capable of emitting a UV radiation beam having properties (e.g., wavelength, power, pulse duration, repetition rate) suitable for causing absorption and consequent fragmentation by the analyte ions of interest. Implementations of embodiments of the present invention may employ a laser, for example, a solid-state laser such as a CryLas (NdYAg) laser which may emit pulsed UV radiation at a wavelength of around 213 nm as UV source 280. One skilled in the art would recognize that many different types of UV or optical lasers could be employed herein without detracting from the spirit and scope of the invention, for example, a more powerful excimer 193 nm laser may be used. The diameter and positioning of UV beam 270 are set or adjusted to give good overlap between ion cloud 260 and irradiated region 285, such that most or all of the unexcited ions within ion trap 210 are exposed to the UV radiation for consequent absorption and fragmentation. In FIG. 2 ion cloud 260 is entirely enveloped by irradiated region 285, although this is not necessary and a portion of the ion cloud may extend outside of the irradiation region. During the UVPD-PTR process, ions may be parked by allowing selected ion fragments with specific or with a range of charge states to be contained in the trap outside of the laser path 285 or by picking a range in m/z space for ion parking. Ion parking (or parallel ion parking) during PTR may be achieved, for example, by using harmonic excitation of selected ions within an ion trap to reduce their reactivity in gas phase ion/ion reactions (first reported by McLuckey et al., 2002, Anal. Chem. 74, pages 336-346; and, Anal. Chem. 2006, 78(1), pages 310-316). Waveforms for parallel ion parking may include a filtered noise field (FNF) waveform where notches in a waveform are included to allow for the uninhibited reaction of selected cations and anions while all products differing in m/z from the selected reactants are subjected to acceleration, thus inhibiting their ion/ion reaction rates. Parallel ion parking via application of broadband waveforms can also be used for simplification of ESI mass spectra of protein mixtures by reducing to one or two the number of charge states per protein. Parallel ion parking may also be effected by application of a single high-amplitude dipolar frequency to the end cap electrodes of an ion trap during an ion/ion reaction period. The use of a single-frequency voltage of high amplitude gives rise to the acceleration of a broad band of m/z values, relative to the use of the same frequency at a much lower amplitude.

Ion parking can be implemented in an ion trap with varying degrees of selectivity depending upon the means employed for inhibiting ion/ion reaction rates. A low-amplitude, single-frequency supplementary ac voltage applied in resonance with an ion of interest is the most selective approach. The use of a broadband waveform or a high-amplitude, single-frequency ac voltage provides means for nonselective ion parking whereby the ions derived from mixtures of analyte species can be parked simultaneously in a process referred to as parallel ion parking. With the latter techniques, ions can be concentrated into an m/z region determined by the characteristics of the applied waveform and the collisional cross section of the ion, with each component of the mixture represented by primarily one or two charge states. Charge states with overlapping m/z values often complicate the deconvolution of an initial protein mixture mass spectrum. Parallel ion parking can help control the range of charge states observed to potentially minimize such overlap problems.

Figure 3:
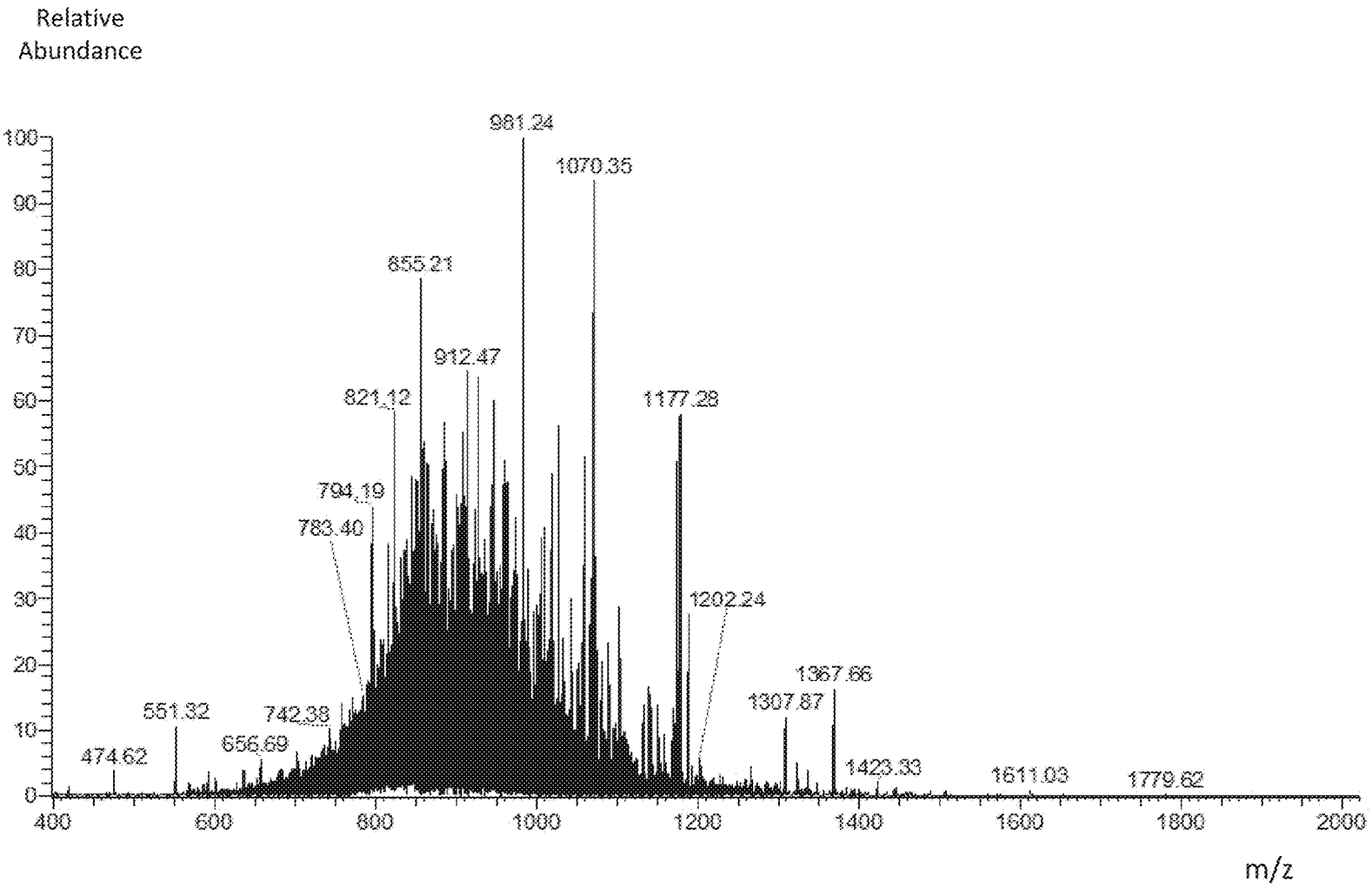
FIG. 3 shows an example of a UVPD mass spectrum without PTR simplification.

FIG. 3 shows a large number of mainly product ion peaks derived from UVPD fragmentation spread over a relatively narrow range of around 800 to 1000 m/z for ions over 10% relative abundance or intensity. Clearly, deconvolution of such a crowded m/z space would be problematic with so many close or overlapping product ion isotopic envelopes.

Figure 4A:
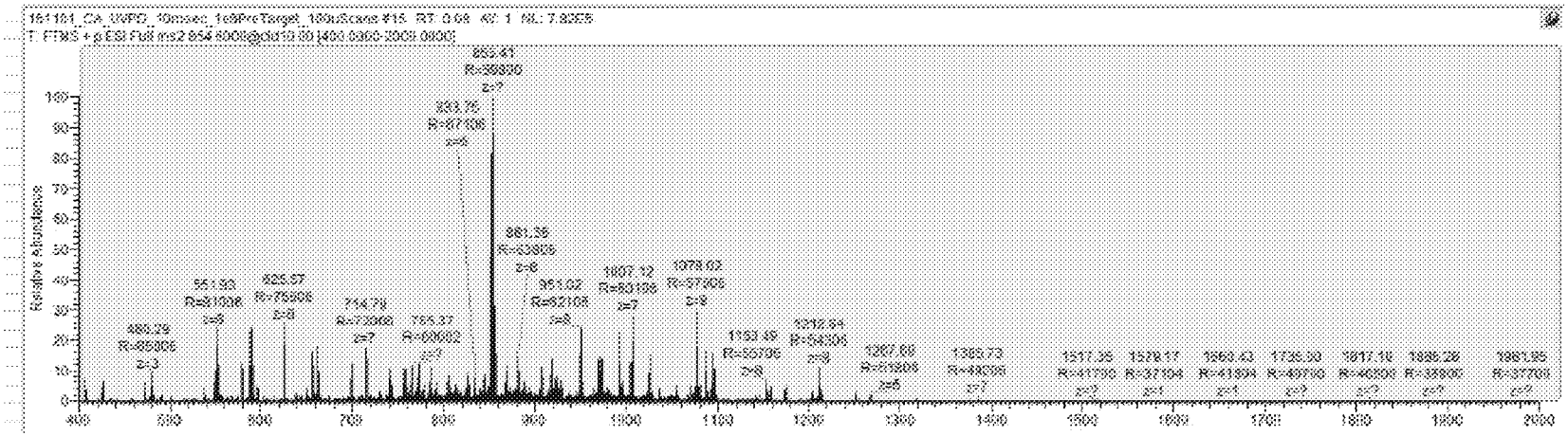
FIG. 4A shows another example of a UVPD mass spectrum without PTR simplification.
Figure 4B:
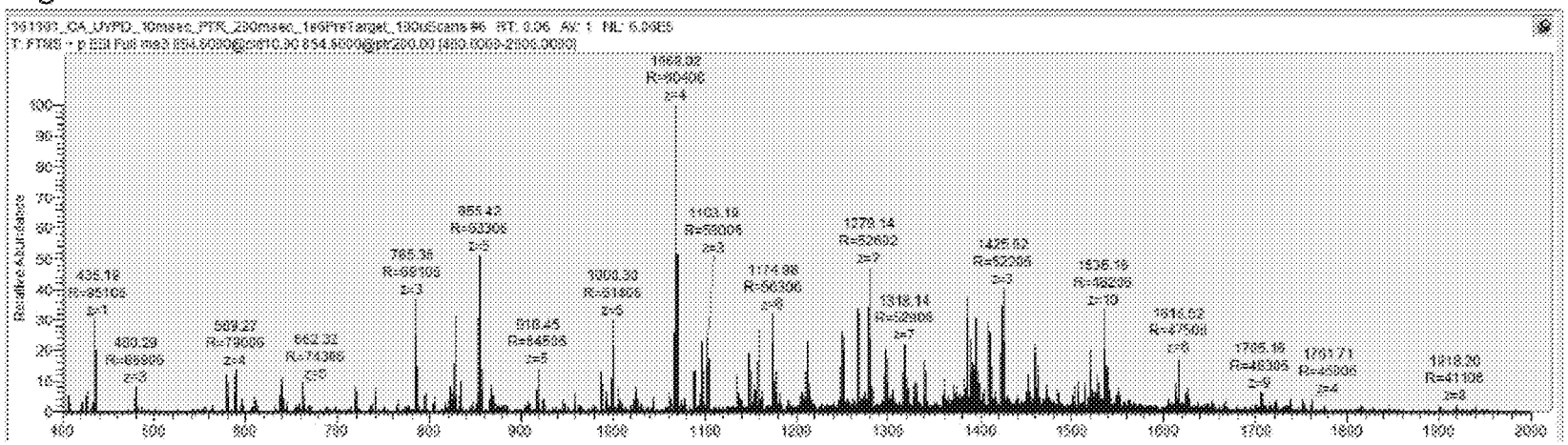
FIG. 4B shows the UVPD mass spectrum in FIG. 4A after PTR simplification.

FIG. 4A shows a mass spectrum where the majority of fragment ion peaks occur in the 400 to 1200 m/z range whereas after 200 ms PTR, FIG. 4B shows the same UVPD fragment ion EIC where the UVPD fragment ion population is spread out over a much broader 400 to 1750 m/z range. Notably, the fragment ion peak cluster at around 855 m/z in FIG. 4A has been dramatically simplified after PTR.

Figure 5:
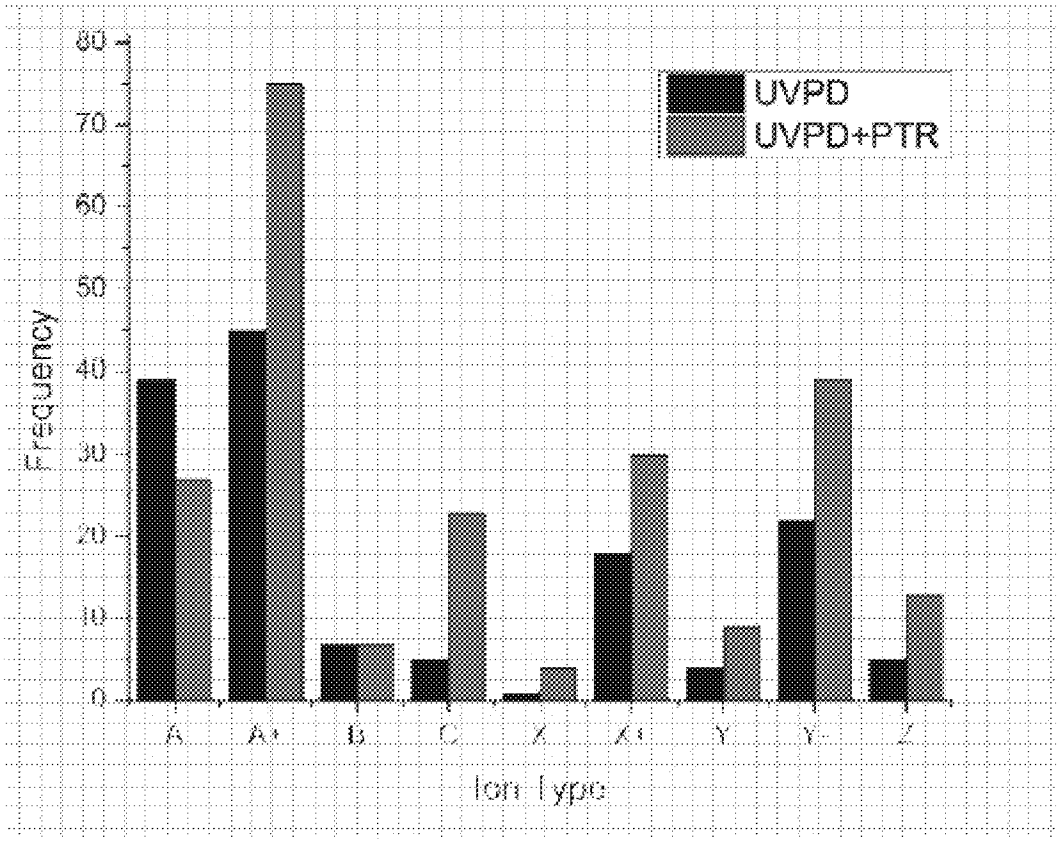
FIG. 5 shows a bar graph comparing the number of UVPD fragments in a mass spectrum versus the peptide ion types.

FIG. 5 is a bar graph showing the number of peptide fragments by specific fragment types (a, b, c, x, y, z) that occur after UVPD (black) and after UVPD-PTR.

There is a charge state dependence to UVPD activation, i.e. the higher the charge state the higher the UVPD cross section. The aim here is to reduce over fragmentation. For the case where a little bit of UVPD is done then PTR, the subsequent UVPD step may see a population of fragments which have been charged reduced. If their cross sections are lower than the otherwise would have been without PTR, then there may be less secondary, tertiary, etc. activation.

The cross section for UVPD activation of proteins is different from that of peptides, with the proteins activating at a much higher rate, i.e., fewer pulses are required to get the same amount of precursor depletion. Therefore, the peptidic like fragments from UVPD activate slower as they go lower in mass. They may be said to be naturally protected due to their decreasing cross section. Could a multiple pulse experiment look different than a single pulse experiment? The answer could be in the fragment partitioning process. If collisions influence the outcome of the UVPD excitation, then a single pulse experiment may be over before a collision occurs. With multiple pulses the time between pulses can be altered to allow for collisional cooling and partitioning. Evidence that this is the case, may be seen as different spectra are seen in a high pressure linear ion trap (HPT) than those seen in a low pressure linear ion trap (LPT). Finer control of dissociation by a multiple UVPD pulse experiment could be advantageous here.

UVPD-PTR may be done with ion parking to a specific m/z range followed by either repeating this process (to build up ion population) or m/z analysis. This could be repeated a number of times by changing the parking range, in effect stitching together mass spectra in various m/z regions. Other embodiments include (a) Product parking during PTR and (b) precursor parking during PTR. This might be advantageous as the product population is moved around in m/z space, without doing PTR on the precursor (i.e.—spread it out into many charge states). Subsequent steps of UVPD-PTR may have more precursor in a single charge state to work with. (c) "Activation by multiple pulses" very fine control of the UVPD activation can be achieved with this approach relative to a high powered laser operating a lower pulse energy. (d) MSn isolation may be performed in a portion of m/z space at any time during the UVPD PTR cycle. It may be performed before PTR, or after PTR and before the next UVPD pulse etc.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that various other modifications may be made in the embodiments chosen for illustration without departing from the spirit and scope of the invention as defined by the claims.

What is claimed is:

1. A method of producing product ions for mass analysis, comprising:

(a) selecting precursor ions for UVPD fragmentation;

(b) performing UVPD fragmentation on the selected precursor ions to give UVPD fragment ions;

(c) performing a PTR on the UVPD fragment ions to yield charge-state reduced UVPD fragment ions;

(d) repeating steps (b) and (c) above n times where n=1 to 50; and, (e) mass analyzing the charge-state reduced UVPD fragment ions.

2. The method of claim 1, wherein the precursor ions are selected by a quadrupole mass filter.

3. The method of claim 1, wherein the precursor ions are selected in a quadrupole ion trap device.

4. The method of claim 3, wherein the precursor ions are selected in a linear quadrupole ion trap device.

5. The method of claim 1, wherein steps (a) through (c) are repeated n times where n=1 to 25.

6. The method of claim 1, wherein steps (a) through (c) are repeated n times where n=1 to 10.

7. The method of claim 1, wherein steps (a) through (c) are repeated n times where n=1 to 5.

8. The method of claim 1, wherein the precursor ions are intact proteins.

9. The method of claim 1, wherein the precursor ions are oligonucleotides.

10. The method of claim 1, wherein the UVPD fragmentation is performed by a laser.

11. The method of claim 1 wherein n=1 to 20 or 1-10 or 1-5.

12. The method of claim 1, wherein the UVPD fragmentation is performed by a light-emitting diode.

13. The method of claim 10 wherein the UVPD fragmentation step is performed using a 213 nm laser.

14. The method of claim 10 wherein the UVPD fragmentation step is performed using a 193 nm laser.

15. The method of claim 1 wherein the UVPD fragmentation step uses a single pulse of laser radiation.

16. The method of claim 1 wherein the UVPD fragmentation step uses a plurality of UVPD laser pulses.

17. The method of claim 1 wherein the proton transfer reaction step is performed using $SF_6$— anions.

18. The method of claim 1 wherein the proton transfer reaction step is performed using a perfluorohydrocarbons anions.

19. The method of claim 1 wherein the proton transfer reaction step is performed using a perfluorodecalin anions.

20. The method of claim 1 wherein MS3 isolation is performed after the UVPD fragmentation step and before the PTR step.

21. The method of claim 1 wherein MSn isolation is performed after the UVPD fragmentation step and before the PTR step.

22. The method of claim 1 wherein ion parking is performed during step (b), wherein a selected ion population is protected from further rounds of UVPD fragmentation.

23. The method of claim 1 wherein ion parking is performed during step (c), wherein a selected ion population is protected from further rounds of PTR.

* * * * *